US009589739B2

(12) United States Patent
Naka et al.

(10) Patent No.: US 9,589,739 B2
(45) Date of Patent: Mar. 7, 2017

(54) ELECTROMAGNETIC CONTACTOR

(71) Applicant: FUJI ELECTRIC FA COMPONENTS & SYSTEMS CO., LTD., Chuo-ku, Tokyo (JP)

(72) Inventors: Yasuhiro Naka, Kounosu (JP); Kouetsu Takaya, Kounosu (JP); Kenji Suzuki, Kounosu (JP); Yuji Shiba, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/676,939

(22) Filed: Apr. 2, 2015

(65) Prior Publication Data

US 2015/0206666 A1 Jul. 23, 2015

Related U.S. Application Data

(63) Continuation of application No. PCT/JP2013/005737, filed on Sep. 26, 2013.

(30) Foreign Application Priority Data

Dec. 12, 2012 (JP) ..... 2012-271279

(51) Int. Cl.
*H01H 1/06* (2006.01)
*H01H 50/54* (2006.01)
(Continued)

(52) U.S. Cl.
CPC ..... *H01H 1/06* (2013.01); *H01H 33/60* (2013.01); *H01H 50/546* (2013.01); *H01H 9/443* (2013.01); *H01H 51/2209* (2013.01)

(58) Field of Classification Search
CPC ..... H01H 1/06; H01H 33/60; H01H 33/64; H01H 50/546; H01H 50/42; H01H 51/00;
(Continued)

(56) References Cited

U.S. PATENT DOCUMENTS 4,421,959 A * 12/1983 Chen ..... H01H 9/38 200/16 A
4,713,636 A * 12/1987 Lemmer ..... H01H 89/08 335/35
(Continued)

FOREIGN PATENT DOCUMENTS

JP H01-157015 A 6/1989
JP H04-312715 A 11/1992
(Continued)

OTHER PUBLICATIONS

Translation JP2002334644 (Org. doc. published Nov. 22, 2002).*
(Continued)

*Primary Examiner* — Renee Luebke
*Assistant Examiner* — William Bolton
(74) *Attorney, Agent, or Firm* — Manabu Kanesaka

(57) ABSTRACT

An electromagnetic contactor includes a fixed contact portion, a movable contact portion disposed facing the fixed contact portion to contact to and separate from the fixed contact portion, and an arc extinguishing receptacle forming an arc extinguishing chamber housing the fixed contact portion and movable contact portion. Among contact surfaces of the movable contact portion and fixed contact portion facing each other, at least an opposing distance between a contact end portion of the fixed contact portion and a contact end portion of the movable contact portion positioned in a moving direction of an arc generated when separating the movable contact portion from the fixed con-
(Continued)

tact portion is set to increase with increasing proximity to end surfaces on contact end portion sides.

3 Claims, 10 Drawing Sheets

(51) Int. Cl.
*H01H 33/60* (2006.01)
*H01H 51/22* (2006.01)
*H01H 9/44* (2006.01)

(58) Field of Classification Search
CPC .. H01H 2050/025; H01H 50/541; H01H 1/66; H01H 9/346
USPC ... 218/146, 110, 107, 123, 22; 335/201, 179
See application file for complete search history.

(56) References Cited

U.S. PATENT DOCUMENTS 4,952,897 A 8/1990 Barnel et al.
5,892,194 A 4/1999 Uotome et al.
5,959,519 A * 9/1999 Gobel ..... H01F 7/1615 335/179
8,994,482 B2 3/2015 Yokoyama et al.
2004/0066261 A1* 4/2004 Nishida ..... H01H 51/2209 335/179
2010/0289604 A1* 11/2010 Kojima ..... H01H 9/443 335/133
2012/0175345 A1 7/2012 Tachikawa et al.
2014/0062625 A1 3/2014 Naka et al.
2015/0034600 A1 2/2015 Isozaki et al.

FOREIGN PATENT DOCUMENTS

JP 2002-334644 A 11/2002
JP 2008-226547 A 9/2008
JP 2012-221759 A 11/2012
JP 5986419 B2 9/2016
WO 2012/157216 A1 11/2012

OTHER PUBLICATIONS

Translation WO2012157170 (Org. doc. published Nov. 22, 2012).*
PCT, "International Search Report for International Application No. PCT/JP2013/005737".
China Patent Office, "Office Action for Chinese Patent Application No. 201380052090.2," Mar. 30, 2016.
Japan Patent Office, "Office Action for Japanese Patent Application No. 2012-271279," Nov. 8, 2016.

* cited by examiner

--------- : ARC

ELECTROMAGNETIC CONTACTOR

CROSS-REFERENCES TO RELATED APPLICATIONS

The present application is a Continuation Application of International Application No. PCT/JP2013/005737 filed Sep. 26, 2013, and claims priority from Japanese Application No. 2012-271279 filed Dec. 12, 2012.

TECHNICAL FIELD

The present invention relates to an electromagnetic contactor that carries out an opening and closing of a current path by contacting and separating fixed contact portions and movable contact portions.

BACKGROUND ART

As a heretofore known electromagnetic contactor, there is, for example, an electromagnetic contactor described in PTL 1. In this electromagnetic contactor, a pair of fixed contact portions is disposed to be separated to left and right, and left and right movable contact portions are disposed vertically facing the fixed contact portions. Each fixed contact portion is provided on a free end of an individual fixed contact terminal formed in an approximate C-shape. Also, the movable contact portion includes a free end portion of movable contact piece extending in a left-right direction. Further, by the movable contact piece being driven, opening and closing of a current path is carried out by each movable contact portion contacting and separating the opposing fixed contact portion.

CITATION LIST

Patent Literature

PTL 1: Japanese Patent No. 3,107,288

SUMMARY OF INVENTION

Technical Problem

An arc is generated when the movable contact portions are separated from the fixed contact portions. The generated arc moves in, for example, the width direction of the movable contact portion and fixed contact portion (a direction perpendicular or approximately perpendicular to the left-right direction) due to the magnetic force of a permanent magnet, and the arc extends laterally when the arc moves as far as an end portion where the movable contact portion and fixed contact portion are not facing each other.

At this time, as the distance at which the movable contact portions and fixed contact portions are facing each other is set to be small, there is a problem in that, as it is difficult for the arc to extend until it moves to the end portion where the movable contact portion and fixed contact portion are not facing each other, the arc stagnation time increases.

Also, when the arc stagnation time is long, because the area facing each other is large while there is a small gap between the contacts, and metal vapor generated by the arc permeates the vicinity of the contacts resulting in a decrease of the insulation, the phenomenon of arc regeneration is liable to occur. This results in a worsening of interruption performance.

The invention, having been contrived focusing on the heretofore described kind of point, has an object of providing an improvement in interruption performance by shortening the arc stagnation time.

Solution to Problem

In order to resolve the heretofore described problem, an electromagnetic contactor according to one aspect of the invention includes a fixed contact portion, a movable contact portion disposed facing the fixed contact portion so as to be capable of contacting to and separating from the fixed contact portion, and an arc extinguishing receptacle forming an arc extinguishing chamber housing the fixed contact portion and the movable contact portion. Further, among contact surfaces of the movable contact portion and fixed contact portion facing each other, at least an opposing distance between a contact end portion of the fixed contact portion and a contact end portion of the movable contact portion is set to increase with increasing proximity to end surfaces on contact end portion sides.

At this time, the opposing distance may be set so as to increase with increasing proximity to the end surface by a corner portion of the contact end portion of the fixed contact portion positioned on a movable contact portion side being a chamfered shape.

Also, the opposing distance may be set so as to increase with increasing proximity to the end surface by a corner portion of the contact end portion of the movable contact portion positioned on the fixed contact portion side being a chamfered shape.

Furthermore, the electromagnetic contactor has a contact conductor portion having the fixed contact portion. The contact conductor portion may include the fixed contact portion disposed facing a surface on a contact side of the movable contact portion and formed with a fixed contact, a fixed contact attachment portion facing a surface on a side opposite to the contact side of the movable contact portion, and an intermediate portion integrally linking the fixed contact portion and the fixed contact attachment portion in a position in a direction intersecting the arc moving direction. Further, the fixed contact attachment portion may be disposed nearer to the movable contact portion than an inner surface of the arc extinguishing receptacle. The electromagnetic contactor may have an insulating cover installed between the fixed contact attachment portion and movable contact portion. The insulating cover includes an opposing surface portion facing a surface on the side opposite to the contact side of the movable contact portion, and left and right upright portions formed on two sides of the opposing surface portion, heading in a direction away from the movable contact portion. Further, the width dimension of the opposing surface portion may be set to be smaller than that of the movable contact portion in a direction along the arc moving direction.

Advantageous Effects of Invention

According to one aspect of the invention, the distance between the movable contact portions and fixed contact portions facing each other, at least between the contact end portions, is set to increase toward the end surface on the contact end portion side. That is, a space formed between the movable contact portions and fixed contact portions is a wedge form space that increases toward the end surface on the contact end portion side (the direction to which an arc is extended).

Because of this, for an arc generated when the movable contact portions are separated from the fixed contact portions, when the arc origin (the position in which the end of the arc is contacting the contact surface) moves to a surface formed with the wedge form space, the opposing distance increases, and the surface of at least one of the movable contact portions and fixed contact portions is oriented diagonally outward, because of which it is easier for the arc to extend outward (the heretofore described arc moving direction). As a result, the timing of the arc extension accelerates. Thus, it is possible to obtain an improvement in interruption performance due to the arc stagnation time being shortened.

Also, at least in the wedge form space, arc extension occurs more easily, because of which the arc moves more smoothly outward. As a result of this, it is possible to also contribute to a suppression of insulation reduction caused by metal vapor.

DESCRIPTION OF EMBODIMENTS

Figure 1:
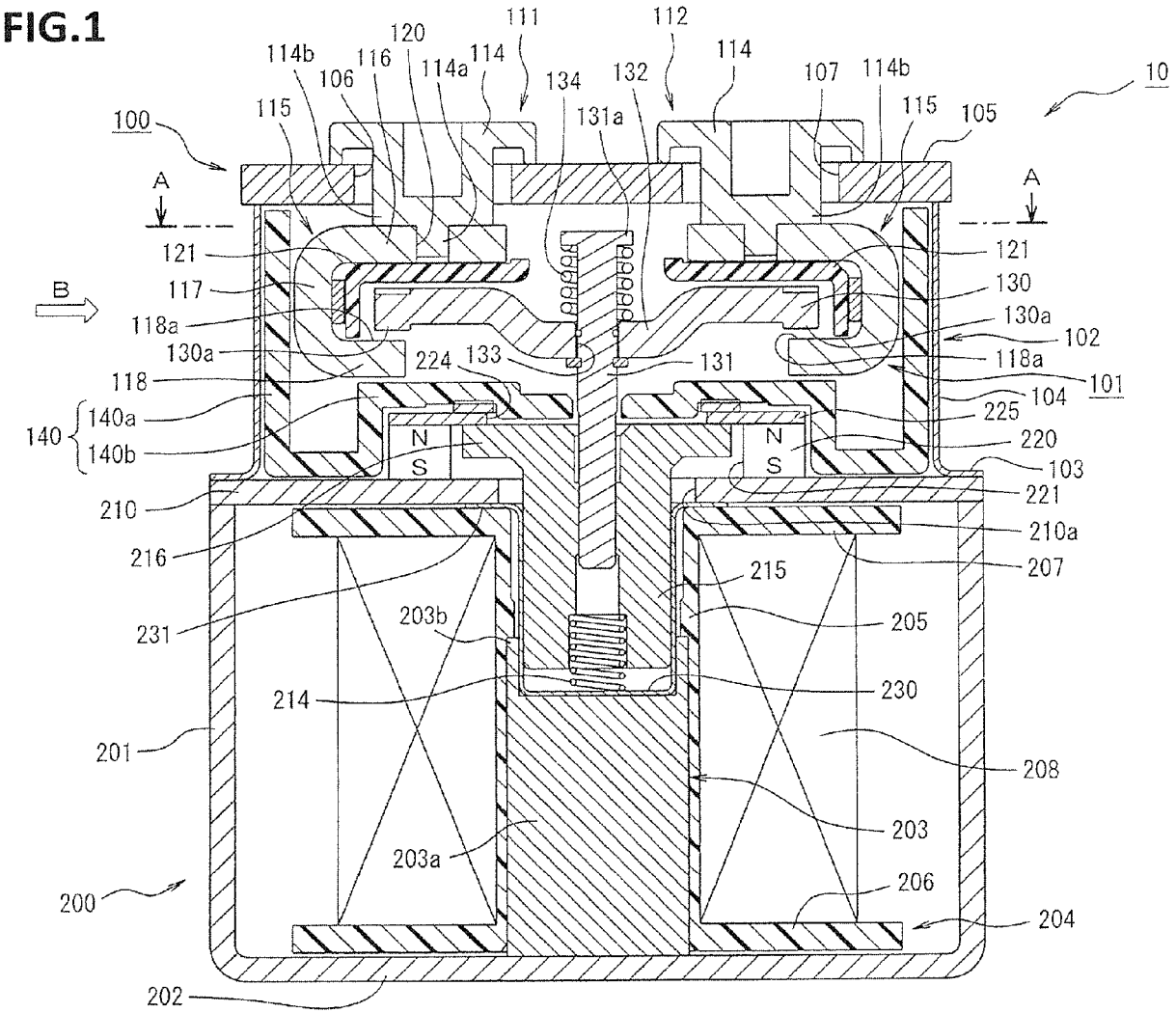
FIG. 1 is a sectional view showing an embodiment of an electromagnetic contactor according to the invention.

Hereafter, a description will be given, referring to the drawings, of an embodiment of the invention.

(Structure)

Figure 2B:
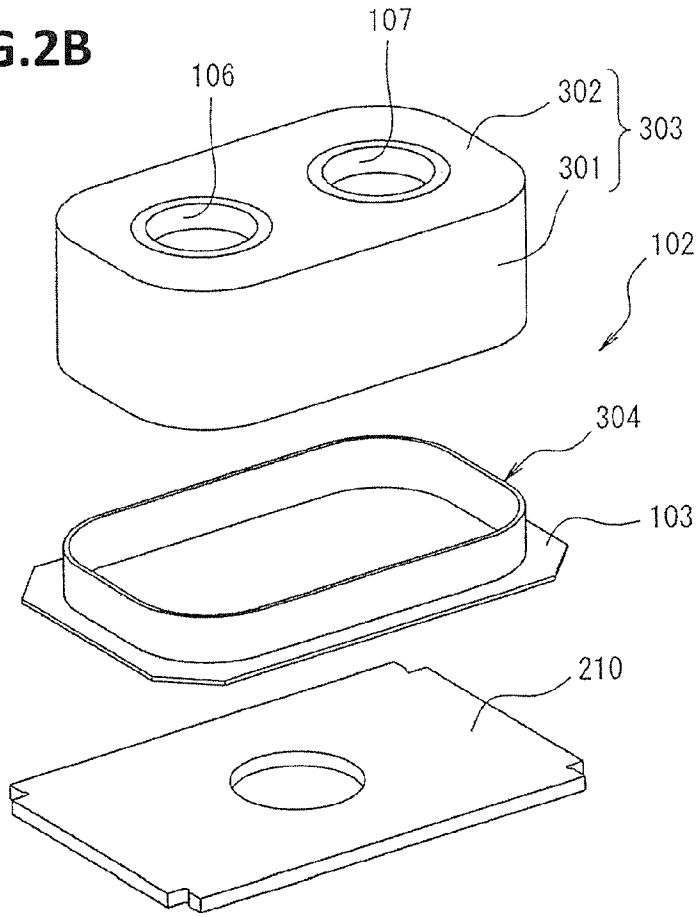
FIGS. 2(*a*), 2(*b*) are exploded perspective views of an arc extinguishing chamber.
Figure 2A:
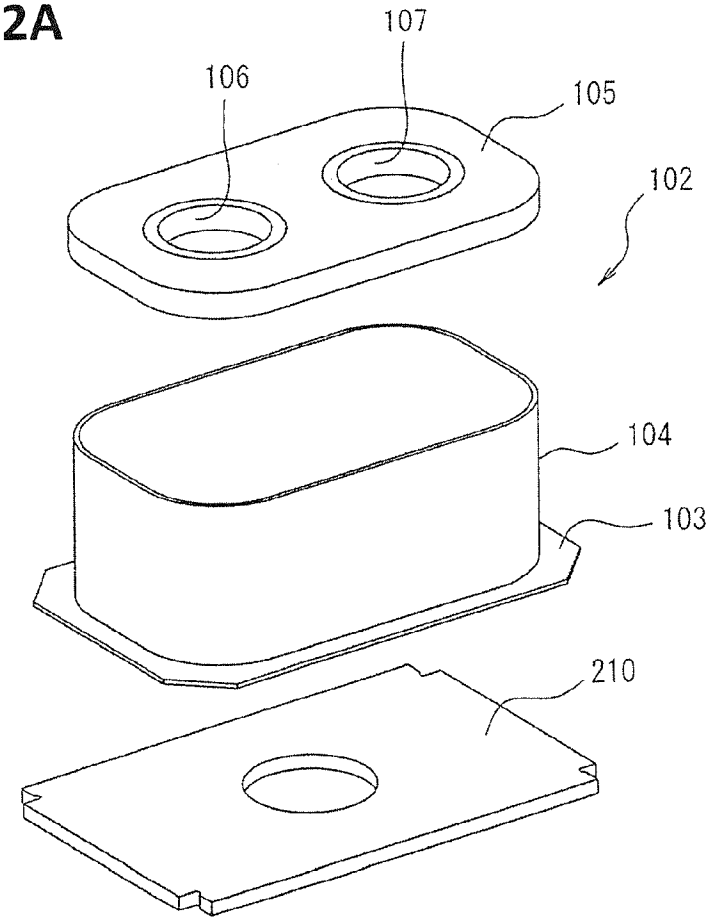

FIG. 1 is a sectional view showing an example of an electromagnetic contactor according to the invention, while FIGS. 2(*a*), 2(*b*) are exploded perspective views of an arc extinguishing chamber. In FIG. 1 and FIGS. 2(*a*), 2(*b*), reference 10 is an electromagnetic contactor, and the electromagnetic contactor 10 includes a contact device 100 disposed with a contact mechanism and an electromagnet unit 200 that drives the contact device 100.

The contact device 100 has an arc extinguishing chamber 102 that houses a contact mechanism 101, as shown in FIG. 1 and FIGS. 2(*a*), 2(*b*). The arc extinguishing chamber 102 includes a metal tubular body 104, and a fixed contact support insulating substrate 105 having a plate-like ceramic insulating substrate that closes off the upper end of the metal tubular body 104, as shown in FIG. 2 (*a*).

The metal tubular body 104 has a flange portion 103 protruding outward on a metal lower end portion. For the metal tubular body 104, the flange portion 103 thereof is seal joined and fixed to an upper portion magnetic yoke 210 of the electromagnet unit 200, to be described hereafter.

Also, through holes 106 and 107 in which a pair of fixed contacts 111 and 112 is inserted, to be described hereafter, are formed maintaining a preset interval in a central portion of the fixed contact support insulating substrate 105. A metalizing process is performed around the through holes 106 and 107 on the upper surface side of the fixed contact support insulating substrate 105, and in a position on the lower surface side that contacts the tubular body 104.

The contact mechanism 101, as shown in FIG. 1, includes the pair of fixed contacts 111 and 112 inserted into and fixed in the through holes 106 and 107 of the fixed contact support insulating substrate 105 of the arc extinguishing chamber 102. Each of the fixed contacts 111 and 112 includes a support conductor portion 114, having a flange portion protruding outward on an upper end thereof, inserted into the through holes 106 and 107 of the fixed contact support insulating substrate 105, and a C-shaped portion 115 having the inner side being opened, linked to the support conductor portion 114 and disposed on the lower surface side of the fixed contact support insulating substrate 105.

The C-shaped portion 115 has a fixed contact attachment portion 116 extending to the outer side along the line of the lower surface of the fixed contact support insulating substrate 105, an intermediate portion 117 extending downward from the outer side end portion of the fixed contact attachment portion 116, and a fixed contact portion 118 extending from the lower end side of the intermediate portion 117, parallel with the fixed contact attachment portion 116, to the inner side, that is, in a direction facing the fixed contacts 111 and 112. In this way, the C-shaped portion 115 is formed in a C-shape wherein the fixed contact attachment portion 116 is added to an L-shape formed by the intermediate portion 117 and fixed contact portion 118.

Figure 3:
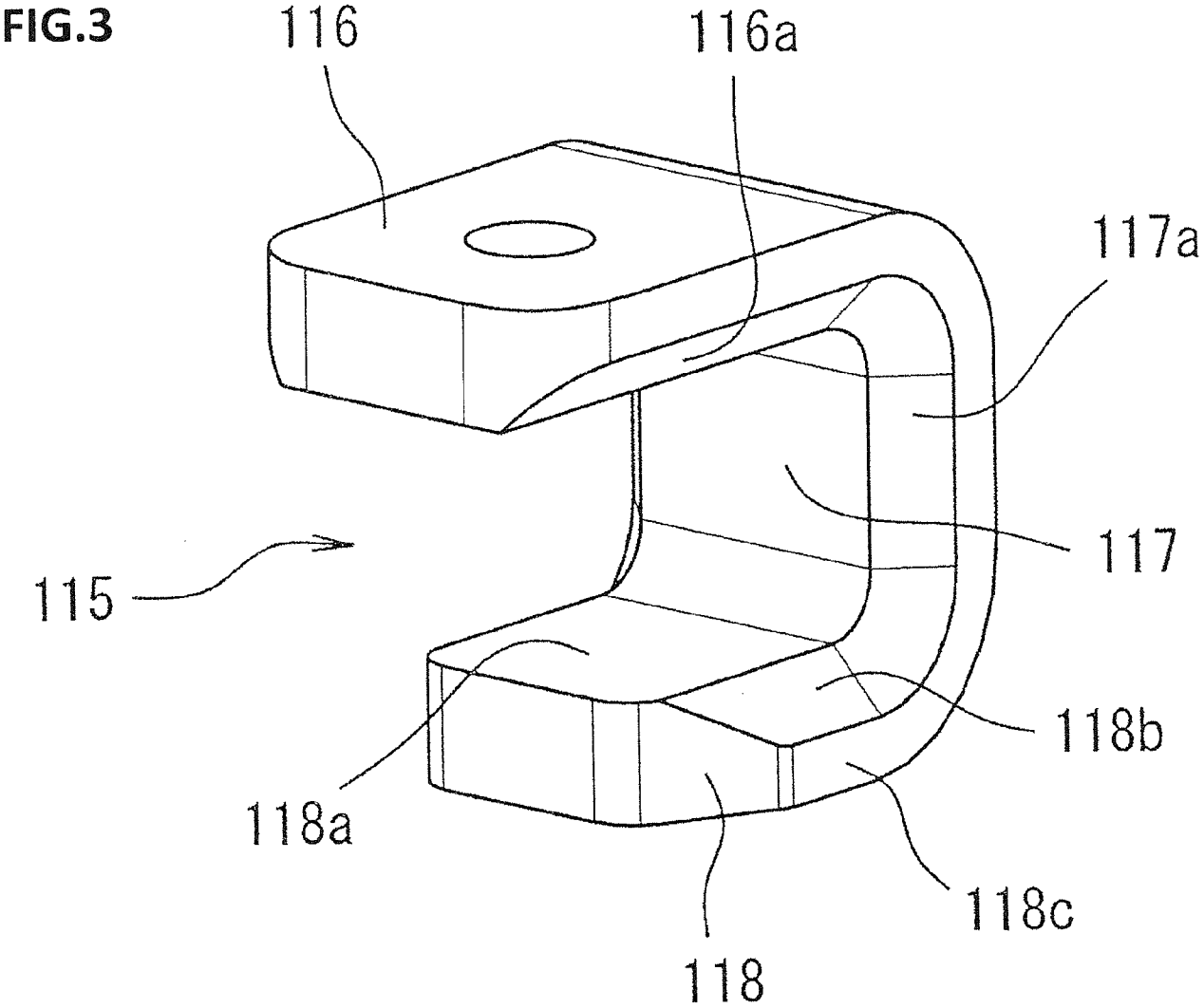
FIG. 3 is a perspective view showing a configuration of a C-shaped portion.

Furthermore, the C-shaped portion 115 of the embodiment is formed such that an inward-facing corner portion of both width direction end portions is a chamfered form in the extension direction thereof, as shown in FIG. 3. In FIG. 3, reference signs 116*a*, 117*a*, and 118*b* indicate chamfered portions. Because of this, both width direction end portions of the fixed contact portion 118 are formed in the chamfered form 118*b*, and both width direction end portions of the fixed contact attachment portion 116 are formed in the chamfered form 116*a*.

Also, as is clear from FIG. 1, the fixed contact attachment portion 116 is disposed jutting further than the fixed contact support insulating substrate 105 to a movable contact portion 130 side.

Herein, a pin 114*a* formed protruding on the lower end surface of the support conductor portion 114 is inserted into a through hole 120 formed in the fixed contact attachment portion 116 of the C-shaped portion 115. In this state, the support conductor portion 114 and C-shaped portion 115 are fixed by, for example, brazing. The fixing of the support conductor portion 114 and C-shaped portion 115, not being limited to brazing, may be done by fitting the pin 114*a* into the through hole 120, or forming an external thread on the pin 114*a* and forming an internal thread in the through hole 120 to screw the two together.

Furthermore, an insulating cover 121 is provided covering the fixed contact attachment portion 116 and intermediate portion 117 of the C-shaped portion 115 of the fixed contacts 111 and 112. The insulating cover 121, being made of a synthetic resin material, is a member that regulates arc generation with respect to the fixed contact attachment portion 116 and intermediate portion 117.

Figure 4:
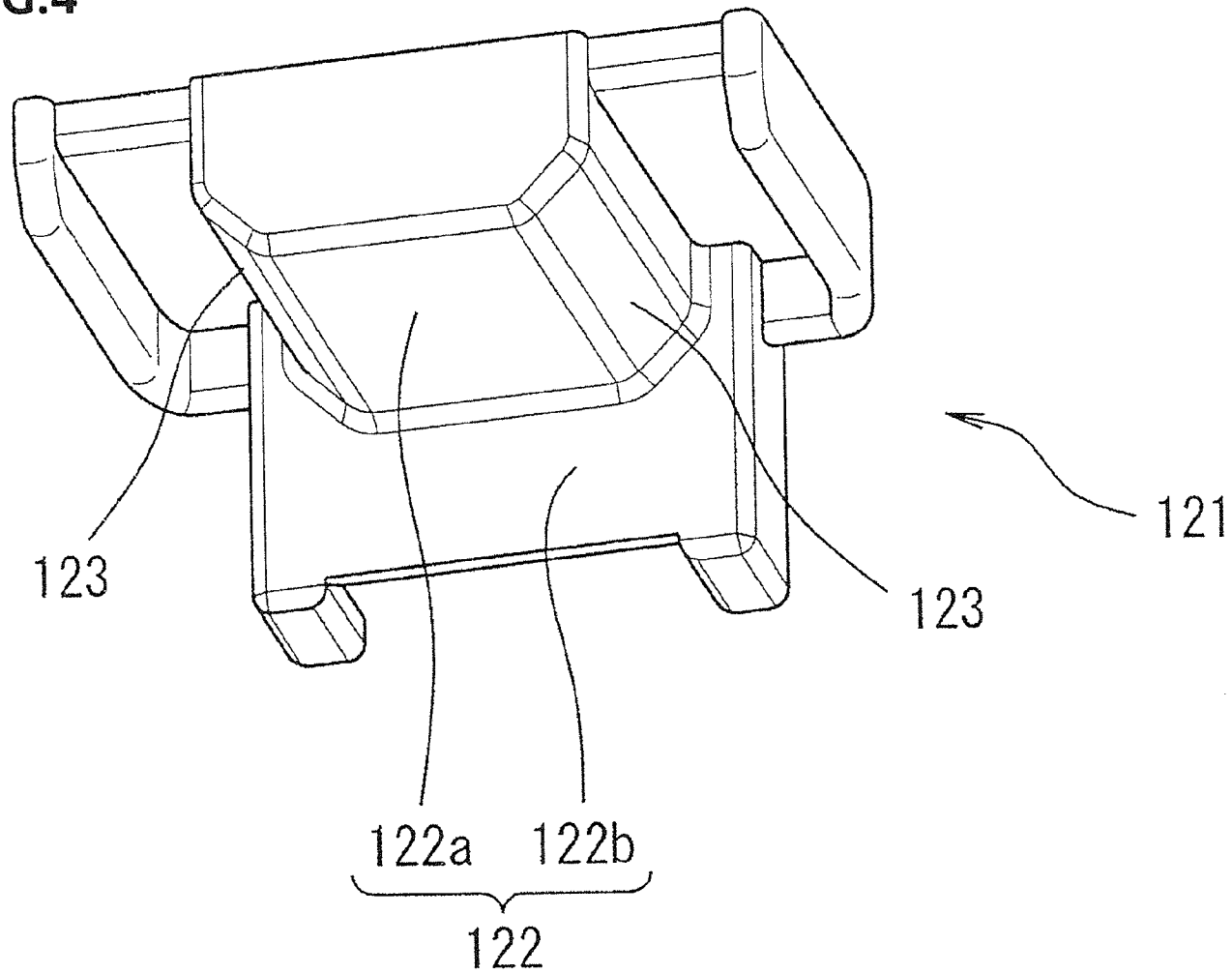
FIG. 4 is a perspective view showing an insulating cover of a contact device viewed from below.
Figure 5:
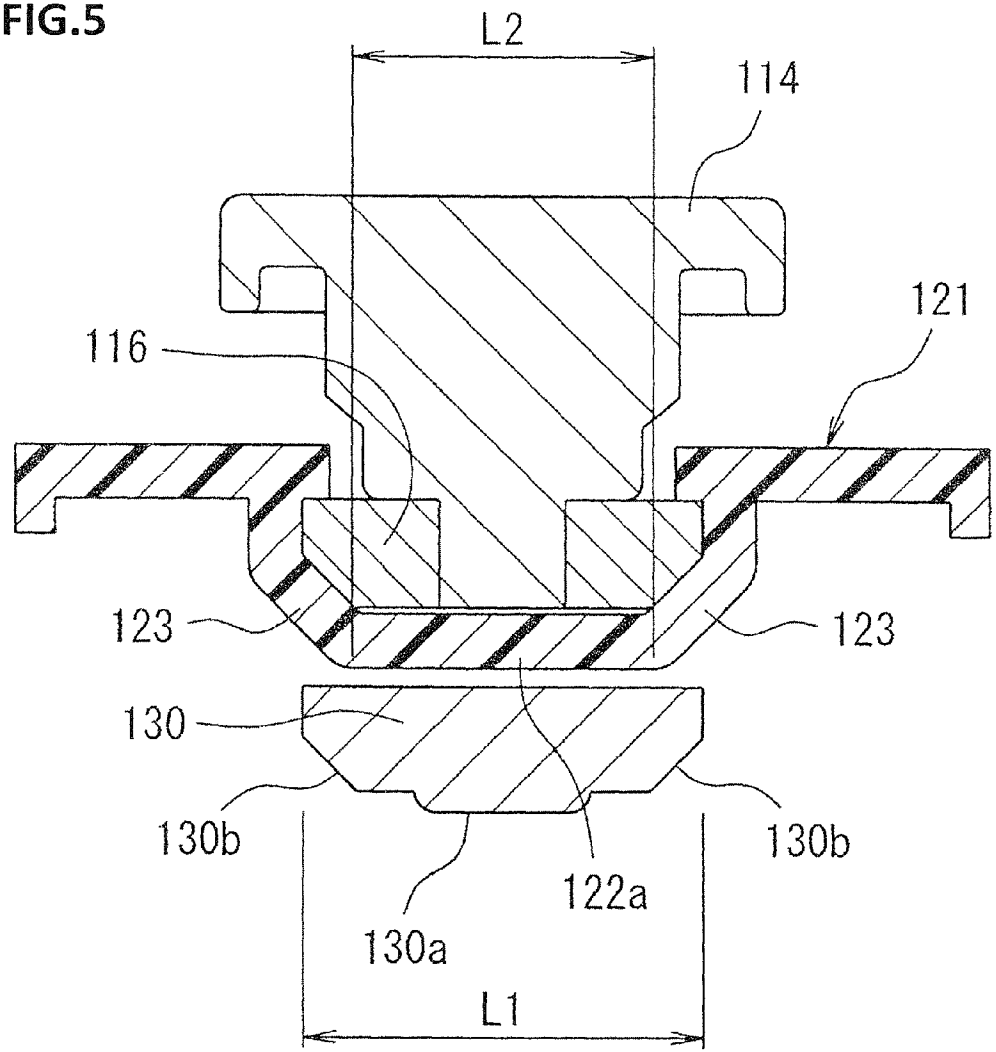
FIG. 5 is a diagram showing the relationship between the C-shaped portion and the insulating cover, viewed from a direction B of FIG. 1.

The insulating cover 121 covers the inner peripheral surfaces of the fixed contact attachment portion 116 and intermediate portion 117 of the C-shaped portion 115. As shown in FIG. 4 and FIG. 5, the insulating cover 121 includes an L-shaped plate portion 122 that follows the inner peripheral surfaces of the fixed contact attachment portion 116 and intermediate portion 117, upright portions 123 extending upward and outward from each of front and back end portions of the L-shaped plate portion 122 and covering side surfaces of the fixed contact attachment portion 116 and intermediate portion 117 of the C-shaped portion 115, and fitting portions (not shown), formed inward from the upper ends of the upright portions 123, that fit into a small diameter portion 114*b* formed in the support conductor portions 114 of the fixed contacts 111 and 112.

Because of the insulating cover 121, only the upper surface side of the fixed contact portion 118 is exposed on the inner peripheral surface of the C-shaped portion 115, and is taken to be a contact portion 118*a*.

Herein, the L-shaped plate portion 122 is formed of an upper cover portion 122*a* facing the fixed contact attachment portion 116 and a side cover portion 122*b* opposing the intermediate portion 117. The upper cover portion 122*a* is disposed in front of a downward facing flat surface of the fixed contact attachment portion 116, as shown in FIG. 5. Also, portions of the upright portions 123 on both left and right sides of the upper cover portion 122*a* are formed in an inclined form following the chamfered form 118*b*. Further, by the fixed contact attachment portion 116 being fitted from a lateral direction onto the upper surface side of the insulating cover 121, the width direction form of the insulating cover 121 is a form following the form of the lower surface of the fixed contact attachment portion 116, as shown in FIG. 5.

Herein, the upper cover portion 122*a* forms an opposing surface portion facing the surface on the side opposite to that of the contact side of movable contact portions 130, as shown in FIG. 5.

Figure 6:
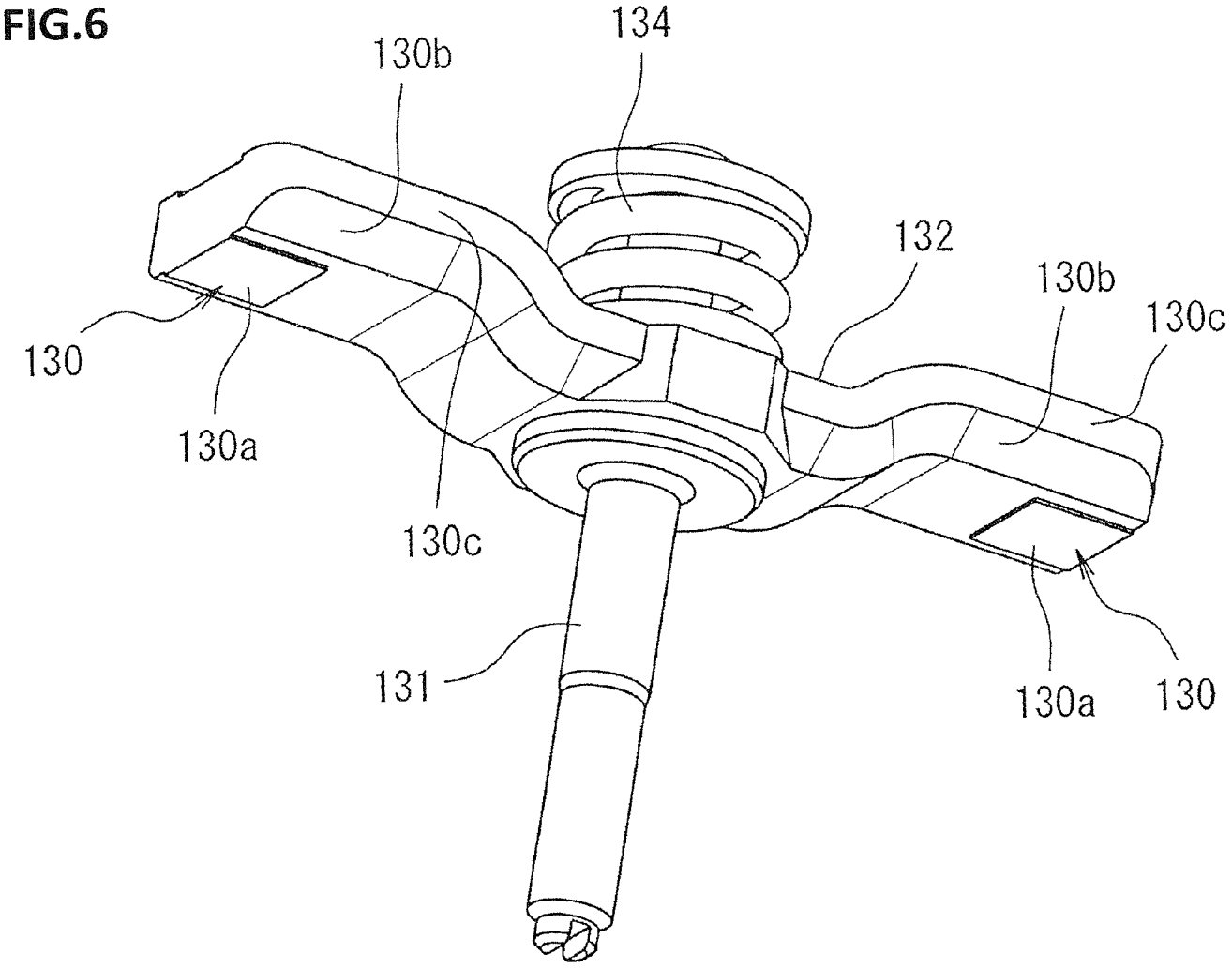
FIG. 6 is a perspective view of a movable contact portion viewed from below.

Furthermore, the left and right movable contact portions 130 are disposed in the C-shaped portion 115 of the fixed contacts 111 and 112. Specifically, a metal movable contact 132 is included extending in the direction in which the left and right fixed contact portions 118 are separated. The movable contact portions 130 are formed on both left and right end portions of the movable contact 132, and each of the movable contact portions 130 formed is disposed in the C-shaped portion 115. The movable contact 132 is supported by a movable support body 131 formed of a shaft body fixed to a movable iron core 215 of the electromagnet unit 200, to be described hereafter. The movable contact 132 is formed with a depressed portion formed protruding downward in the vicinity of the movable support body 131 positioned in a central portion, and a through hole 133 formed in the depressed portion through which the movable support body 131 is inserted, as shown in FIG. 1 and FIG. 6. A flange portion 131*a* protruding outward is formed on the upper end of the movable support body 131. The movable support body 131 is inserted from the lower end side through a contact spring 134, then inserted through the through hole 133 of the movable contact 132, bringing the upper end of the contact spring 134 to contact the flange portion 131*a*. Further, the movable contact 132 is positioned using, for example, a C-ring 135 so as to obtain a preset urging force from the contact spring 134.

The movable contact portions 130 are formed such that corner portions of both width direction end portions of the lower surface facing the fixed contact portions 118 are chamfered, to form chamfered forms 130*b*, as shown in FIGS. 5 and 6. Herein, in the embodiment, an example is given using a case wherein the width direction dimensions of the movable contact portions 130 and fixed contact portions 118 are the same dimension.

Figure 7:
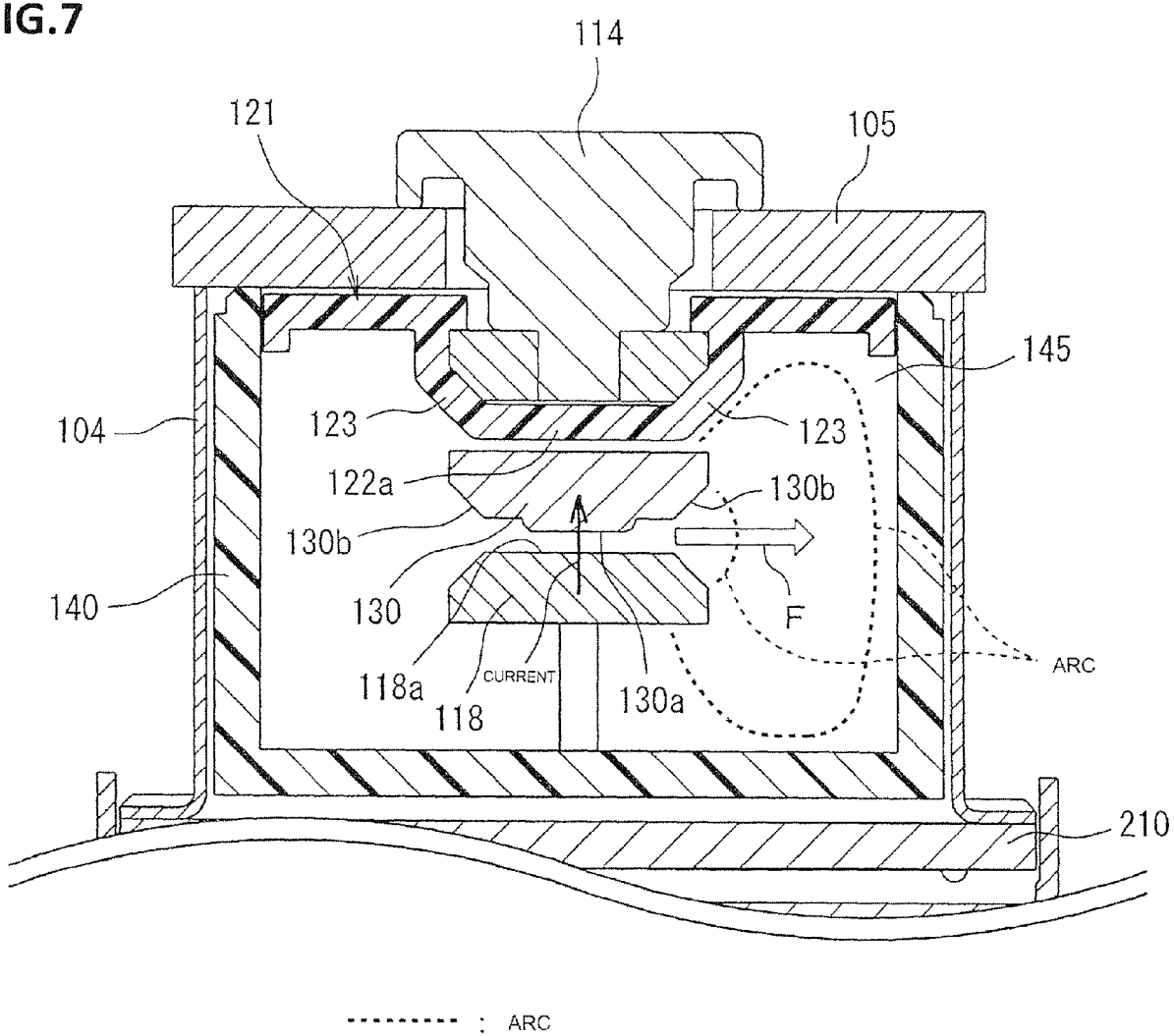
FIG. 7 is a schematic view showing the relationship between the movable contact portion, a fixed contact portion, and the insulating cover.

The movable contact portions 130, in a released state, become a state wherein contact portions 130*a* at either end and the contact portions 118*a* of the fixed contact portions 118 of the C-shaped portions 115 of the fixed contacts 111 and 112 are separated from each other and maintaining a preset interval, as shown in FIG. 1 and FIG. 7. Also, the movable contact portions 130 are set so that, in an engaged position, the contact portions at either end contact the contact portions 118*a* of the fixed contact portions 118 of the C-shaped portions 115 of the fixed contacts 111 and 112 at a preset contact pressure from the contact spring 134.

The electromagnet unit 200, as shown in FIG. 1, includes the movable iron core 215, of which one end portion side is linked to the movable support body 131 and whose axis is in a direction following the drive direction of the movable support body 131, a fixed iron core 203, disposed coaxially with the movable iron core 215 on the other axial direction end portion side of the movable iron core 215, extending in a direction away from the movable iron core 215, and an exciting coil 208 disposed on at least the outer peripheral side of the fixed iron core 203. Also, the electromagnet unit 200 has a magnetic yoke 201 of a flattened U-shape when viewed from the side, as shown in FIG. 1.

The fixed iron core 203 is disposed in an upright state in a central portion of a bottom plate portion 202 of the magnetic yoke 201. The fixed iron core 203 is formed of a columnar fixed iron core main body 203*a* and a bottomed depressed portion 203*b* of a bottomed tubular form, formed in an upper portion of the fixed iron core main body 203*a* and opened upward. The fixed iron core main body 203*a* extends upward in a state wherein the lower end surface is contacting the upper surface in a central portion of the bottom plate portion 202 of the magnetic yoke 201. The bottomed tubular form bottomed depressed portion 203*b* is formed such that a lower end portion of the movable iron core 215 can be inserted therein.

A spool 204 is disposed as a plunger drive portion on the outer side of the fixed iron core 203. The spool 204 includes a central cylinder portion 205 in which the fixed iron core 203 is inserted, a lower flange portion 206 protruding outward in a radial direction from a lower end portion of the central cylinder portion 205, and an upper flange portion 207 protruding outward in a radial direction from the upper end of the central cylinder portion 205. Further, the exciting coil 208 is mounted wound in a housing space having the central cylinder portion 205, lower flange portion 206, and upper flange portion 207.

Further, the upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable iron core 215 is disposed in a position in an upper portion of the central cylinder portion 205 of the spool 204 so as to be capable of sliding up and down. An upper portion of a return spring 214 is simultaneously attached to the lower end surface of the movable iron core 215. A peripheral flange portion 216 protruding outward in a radial direction is formed on the movable iron core 215, in a position on an upper end portion protruding upward from the upper magnetic yoke 210.

Also, a permanent magnet 220 formed in a ring-form is fixed to the upper surface of the upper magnetic yoke 210. The permanent magnet 220 is disposed so as to enclose the peripheral flange portion 216 of the movable iron core 215. The permanent magnet 220 has a through hole 221 enclosing the peripheral flange portion 216. The permanent magnet 220 is magnetized in an up-down direction, that is, a thickness direction, so that the upper end side is, for example, an N-pole while the lower end side is an S-pole. The form of the through hole 221 of the permanent magnet 220 is a form tailored to the form of the peripheral flange portion 216, while the form of the outer peripheral surface can be an arbitrary form such as circular or rectangular.

Further, an auxiliary yoke 225 of the same external form as the permanent magnet 220, and having a through hole 224 of an inner diameter smaller than the outer diameter of the peripheral flange portion 216 of the movable iron core 215, is fixed to the upper end surface of the permanent magnet 220. The peripheral flange portion 216 of the movable iron core 215 faces the lower surface of the auxiliary yoke 225.

Also, the movable support body 131 that supports the movable contact portions 130 is screwed to the upper end surface of the movable iron core 215.

Further, in a released state, the movable iron core 215 is urged upward by the return spring 214, and the upper surface of the peripheral flange portion 216 attains a released position wherein it contacts the lower surface of the auxiliary yoke 225. In this state, the contact portions 130*a* of the movable contact portions 130 have moved away upward from the contact portions 118*a* of the fixed contacts 111 and 112, causing a state wherein current is interrupted.

In the released state, the peripheral flange portion 216 of the movable iron core 215 is suctioned to the auxiliary yoke 225 by the magnetic force of the permanent magnet 220, and by a combination of this magnetic force and the urging force of the return spring 214, the state in which the movable iron core 215 contacts the auxiliary yoke 225 is maintained, with no unplanned downward movement due to vibration, shock, or the like, from the exterior.

Further, at least the lower end portion side of the movable iron core 215 is covered with a cap 230, formed in a bottomed tubular form, made of a non-magnetic body and opened upward.

The bottom portion side of the cap 230 is inserted so as to fit inside the bottomed depressed portion 203*b* of the fixed iron core 203. By so doing, the bottom end portion side of the movable iron core 215 attains a state wherein it is in proximity to the interior of the bottomed depressed portion 203*b* of the fixed iron core 203 across the cap as shown in FIG. 1.

Also, a flange portion 231 formed extending outward in a radial direction on an opened end of the cap 230 is seal joined to the lower surface of the upper magnetic yoke 210. By so doing, a hermetic receptacle (sealed structure), wherein the arc extinguishing chamber 102 and cap 230 communicate via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the arc extinguishing chamber 102 and cap 230. Because of this, the movable iron core 215 is positioned inside the hermetic receptacle.

A description has been given of a case in which a hermetic receptacle includes the arc extinguishing chamber 102 and cap 230, and gas is encapsulated inside the hermetic receptacle, but not being limited to this, and the gas encapsulation may be omitted when the interrupted current is small.

(Operation)

Next, a description will be given of an operation of the electromagnetic contactor of the heretofore described embodiment.

Herein, it is assumed that the fixed contact 111 is connected to, for example, a power supply source that supplies a large current, while the fixed contact 112 is connected to a load.

In this state, the exciting coil 208 in the electromagnet unit 200 becomes a non-exciting state, and there exists a released state wherein no exciting force causing the movable iron core 215 to descend is being generated in the electromagnet unit 200. In this released state, the movable iron core 215 is urged in an upward direction away from the upper magnetic yoke 210 by the return spring 214. Simultaneously with this, a suctioning force created by the magnetic force of the permanent magnet 220 acts on the auxiliary yoke 225, and the peripheral flange portion 216 of the movable iron core 215 is suctioned. Because of this, the upper surface of the peripheral flange portion 216 of the movable iron core 215 contacts the lower surface of the auxiliary yoke 225.

Because of this, the contact portions 130*a* of the contact mechanism 101 movable contact portions 130 linked to the movable iron core 215 via the movable support body 131 are separated by a preset distance upward from the contact portions 118*a* of the fixed contacts 111 and 112. Because of this, the current path between the fixed contacts 111 and 112 become an interrupted state, and the contact mechanism 101 becomes an opened contact state.

In this way, as the urging force of the return spring 214 and the suctioning force of the annular permanent magnet 220 both act on the movable iron core 215 in the released state, there is no unplanned downward movement of the movable iron core 215 due to vibration, shock, or the like, from the exterior, and it is thus possible to reliably prevent malfunction.

On the exciting coil 208 of the electromagnet unit 200 being excited in the released state, an exciting force is generated in the electromagnet unit 200, and the movable iron core 215 is pressed downward against the urging force of the return spring 214 and the suctioning force of the annular permanent magnet 220.

By the movable iron core 215 descending in this way, the movable contact portions 130 linked to the movable iron core 215 via the movable support body 131 also descend, and the contact portions 130*a* thereof contact the contact portions 118*a* of the fixed contacts 111 and 112 with the contact pressure of the contact spring 134.

When interrupting the supply of current to the load in the closed contact state of the contact mechanism 101, the exciting of the exciting coil 208 of the electromagnet unit 200 is stopped.

Because of this, there is no longer an exciting force causing the movable iron core 215 to move downward in the electromagnet unit 200. Consequently, the movable iron core 215 is raised by the urging force of the return spring 214, and the suctioning force of the annular permanent magnet 220 increases as the peripheral flange portion 216 nears the auxiliary yoke 225.

By the movable iron core 215 rising, the movable contact portions 130 linked via the movable support body 131 rise. As a result of this, the movable contact portions 130 contact the fixed contacts 111 and 112 for as long as contact pressure is applied by the contact spring 134. Subsequently, there starts an opened contact state, wherein the movable contact portions 130 move upward away from the fixed contacts 111 and 112 at the point at which the contact pressure of the contact spring 134 stops.

On the opened contact state starting, an arc is generated between the contact portions 118*a* of the fixed contacts 111 and 112 and the contact portions 130*a* of the movable contact portions 130, and the state in which current is conducted continues due to the arc.

At this time, as the insulating cover 121 is mounted covering the fixed contact attachment portion 116 and intermediate portion 117 of the C-shaped portion 115 of the fixed contacts 111 and 112, it is possible to cause the arc to be generated only between the contact portions 118*a* of the fixed contacts 111 and 112 and the contact portions 130*a* of the movable contact portions 130. Because of this, it is possible to stabilize the arc generation state, and thus possible to improve arc extinguishing performance.

When a current I flows from the fixed contact side to the movable contact 130 side between the contact portions 118*a* of the fixed contacts and the contact portions 130*a* of the movable contact portions 130, and a magnetic field oriented upward with respect to the plane of the drawing is formed by an external magnet (not shown), as shown in FIG. 7, a large Lorentz force F acts in accordance with Fleming's left-hand rule toward an arc extinguishing space 145 side, perpendicular to the longitudinal direction of the movable contact portions 130 and perpendicular to the switching direction of the contact portions 118*a* of the fixed contacts and the movable contact portions 130.

Due to the Lorentz force F, an arc generated between the contact portions 118*a* of the fixed contacts and the contact portions 130*a* of the movable contacts 130, moving in the direction of the Lorentz force F of FIG. 7, is greatly extended so as to pass from side surfaces of the contact portions 118*a* of the fixed contacts through the inside of the arc extinguishing space 145, reaching the upper surface sides of the movable contact portions 130, and is extinguished.

Figure 8A:
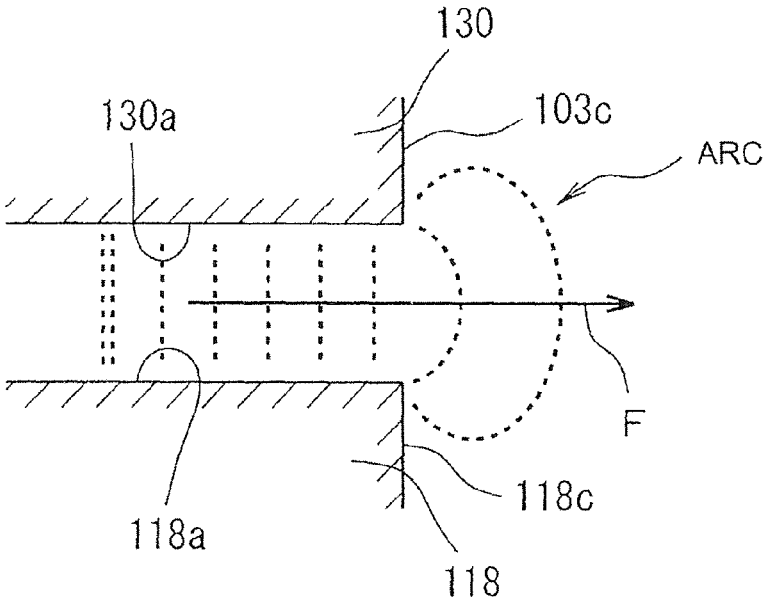
FIGS. 8(*a*), 8(*b*) are diagrams illustrating arc movement.
Figure 8B:
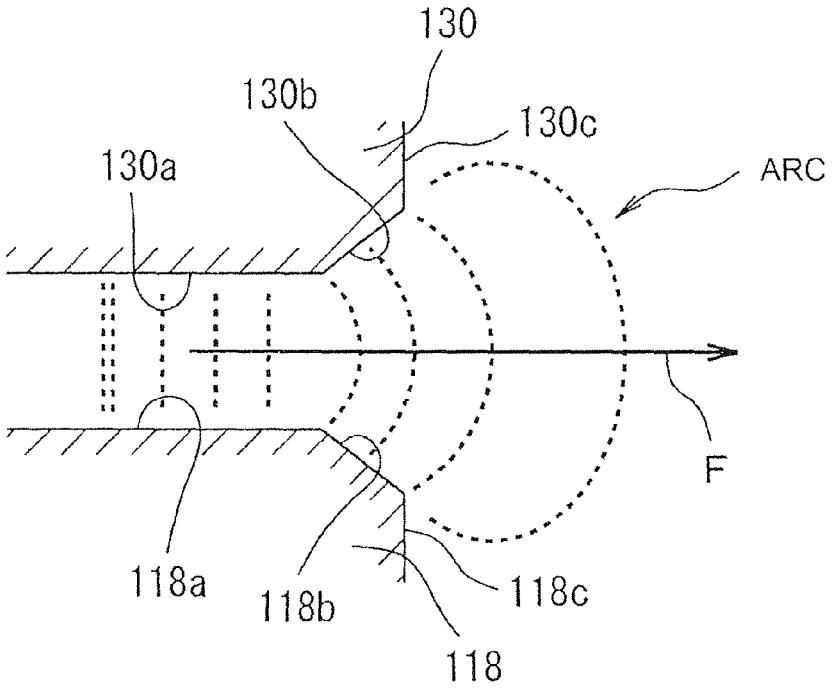

At this time, when the distance at which the fixed contact portions 118 and movable contact portions 130 fac each other is practically the same, as in FIG. 8(*a*), it is difficult for the arc to extend outward until the arc moves to an end surface position on both width direction end portion (contact end portion) sides. Because of this, the arc stagnation time becomes commensurately longer. Also, when the arc stagnation time is long, because the area facing each other is large while there is a small gap between the contacts, and metal vapor generated by the arc permeates the vicinity of the contacts decreasing the insulation, the phenomenon of arc regeneration is liable to occur. This results in a worsening of interruption performance.

In contrast, in the embodiment, the chamfered forms 130*b* and 118*b* are formed in the contact end portions, whereby a wedge form space opening outward is formed between the fixed contact portions 118 and movable contact portions 130 in the contact end portions, as in FIG. 8(*b*). That is, the distance at which the movable contact portions and fixed contact portions are facing each other, at least between the contact end portions, is set to increase toward the end surface on the contact end portion side. That is, the space formed between the movable contact portions and fixed contact portions is a wedge form space that becomes larger toward the end surface on the contact end portion side.

Because of this, for an arc generated when the movable contact portions are separated from the fixed contact portions, when the arc origin (the position in which the end of the arc is contacting the contact surface) moves to a surface formed with the wedge form space, the distance facing each other increases, and the surface of at least one of the movable contact portions and fixed contact portions is oriented diagonally outward, as shown in FIG. 8 (*b*), because of which it is easier for the arc to extend outward (the heretofore described arc moving direction). As a result, the timing of the arc extension accelerates. Thus, it is possible to obtain an improvement in interruption performance due to the arc stagnation time being shortened.

Also, at least in the wedge form space, the arc moves more smoothly outward, because of which it is possible to also contribute to a suppression of insulation reduction caused by metal vapor. Also, as a result of a decrease in the area of the portion in which the distance at which the contact portions are facing each other is small, it is possible to also make it difficult for the arc regeneration phenomenon to occur.

Also, in the embodiment, a width direction dimension L2 of the upper cover portion 122*a* of the insulating cover 121 is set to be smaller than a width direction dimension L1 of the upper surface side of the movable contact portion 130, as shown in FIG. 5.

Figure 9:
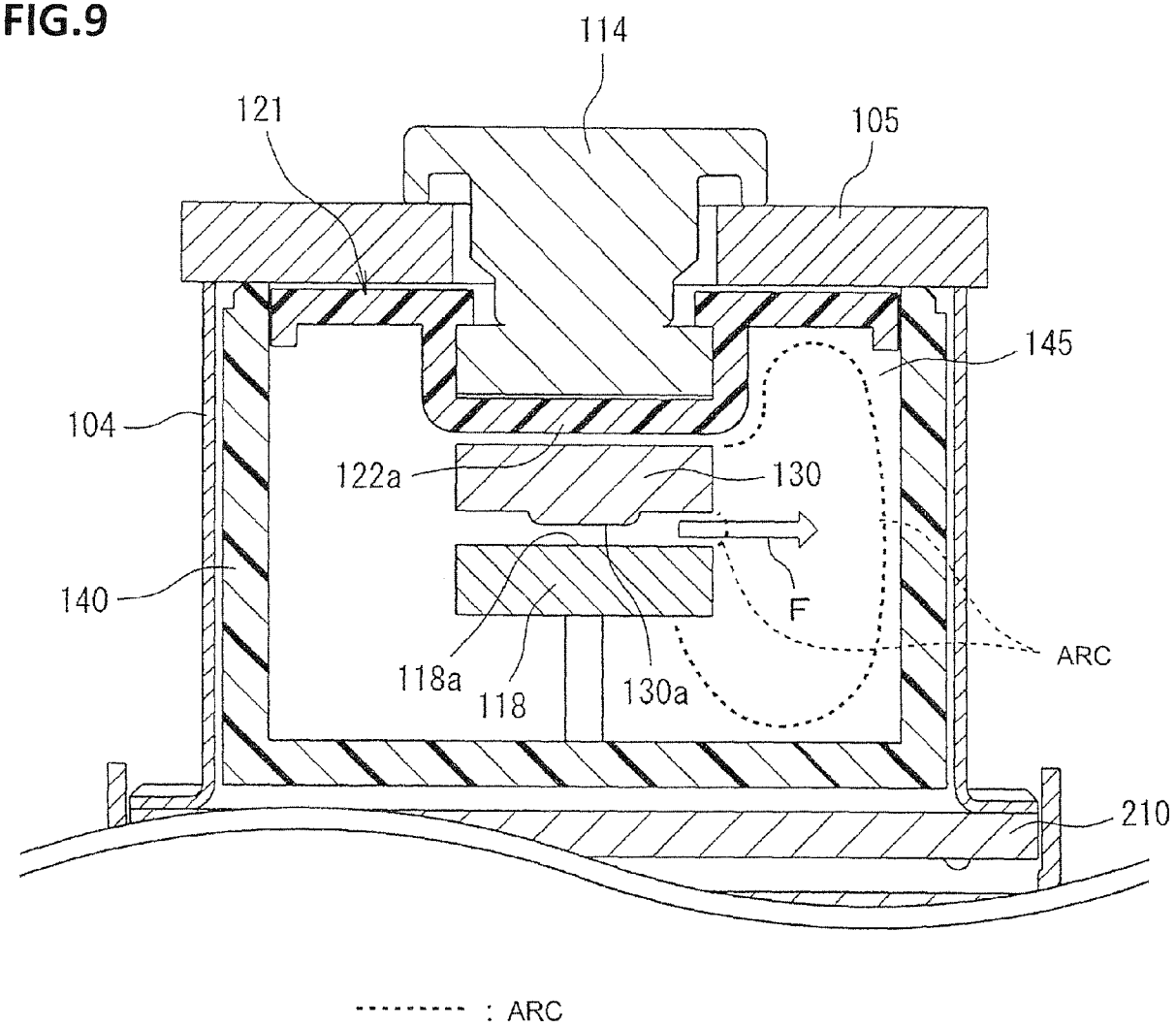
FIG. 9 is a schematic view showing a comparison example of the relationship between the movable contact portion, fixed contact portion, and insulating cover.

Herein, when the width direction dimension L2 of the upper cover portion 122*a* of the insulating cover 121 is greater than the width direction dimension L1 of the upper surface side of the movable contact portion 130, as shown in FIG. 9, the extended arc does not turn onto the upper surface side of the movable contact portion and the arc movement is restricted, as shown in FIG. 9.

In contrast, in the embodiment, arc extinguishing is accelerated by the extended arc also turning onto the upper surface side of the movable contact portion, whereby the arc extension is further increased, as shown in FIG. 7.

Modification Examples

Figure 10:
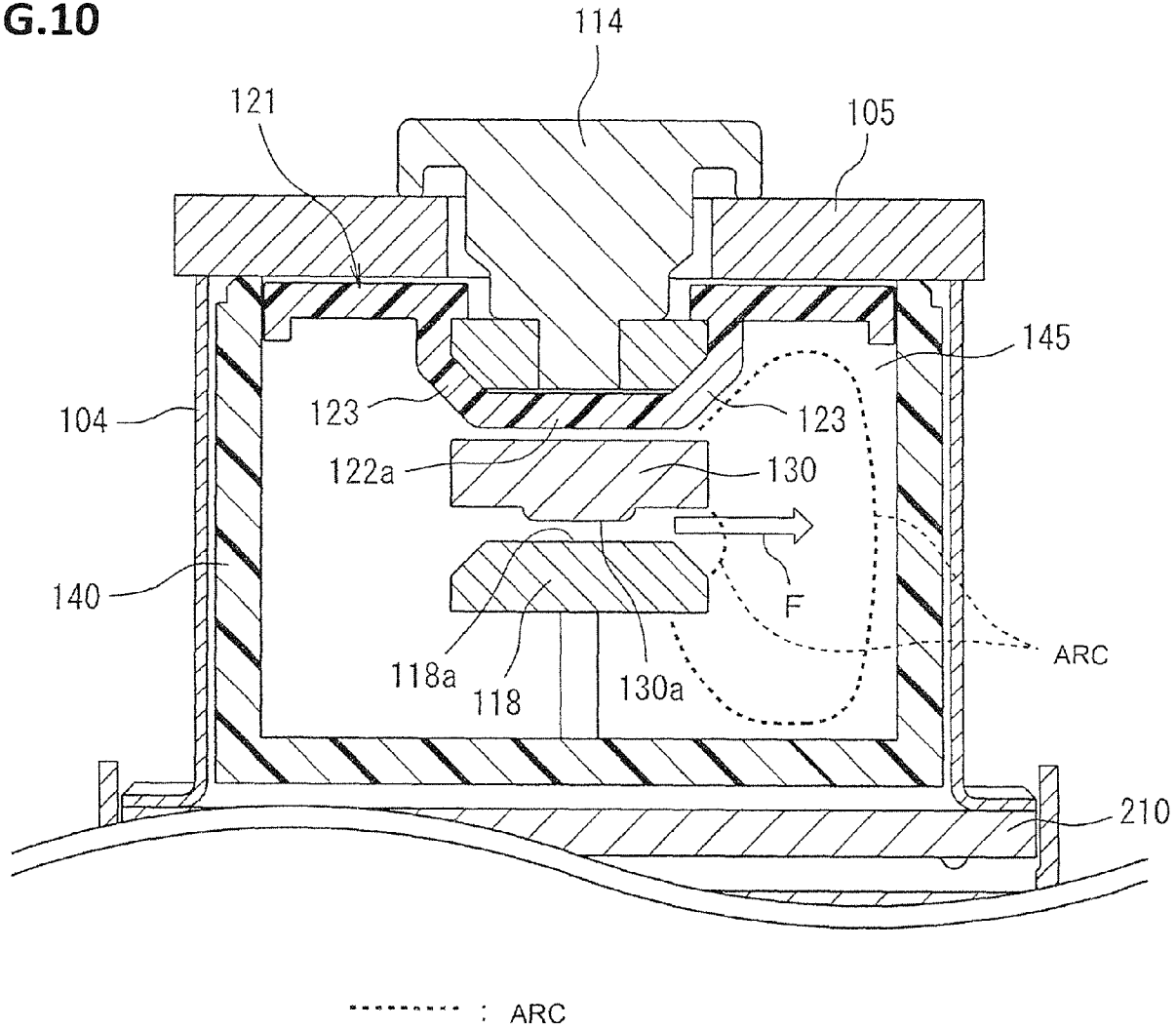
FIG. 10 is a schematic view showing another embodiment of the relationship between the movable contact portion, fixed contact portion, and insulating cover.

Herein, in the description above, a case wherein the chamfered forms 130*b* and 118*b* are formed in both the movable contact portions 130 and fixed contact portions 118 is given as an example. A chamfered form may also be formed in only one of the movable contact portions 130 and fixed contact portions 118. A case wherein the chamfered form 118*b* is formed in only the fixed contact portions 118 is given as an example in FIG. 10. The operational advantage thereof is also the same as in the heretofore described embodiment.

Also, by forming a curve in the corner portions of the contact corner portions instead of a chamfered form, the distance at which the movable contact portions 130 and fixed contact portions 118 are facing each other may be set to increase toward the end surfaces.

Also, although the eventual arc extension is shorter, the width direction dimension L2 of the upper cover portion 122*a* of the insulating cover 121 may be set to be greater than the width direction dimension L1 of the upper surface side of the movable contact portion 130.

Advantages of Embodiment

The following kinds of advantage are obtained with the electromagnetic contactor 10 of the embodiment.

(1) Among contact surfaces of the movable contact portions 130 and fixed contact portions 118 facing each other, at least the opposing distance between the contact end portion of the fixed contact portion 118 and contact end portion of the movable contact portion 130 positioned in the movement direction of an arc generated when separating the movable contact portions 130 from the fixed contact portions 118 is set to increase with increasing proximity to end surfaces 118*c* and 130*c* on the contact end portion sides.

According to this configuration, extension of a generated arc occurs at an earlier stage. As a result of this, the arc stagnation time is shortened commensurately. This leads to the arc moving smoothly, and also contributes to suppression of insulation reduction caused by metal vapor. Also, as there is a reduction in the area in which the distance at which the contact portions are facing each other is small, it is possible to also make it difficult for the arc regeneration phenomenon to occur.

Because of the above, arc interruption performance improves.

(2) A corner portion of the contact end portion of the fixed contact portion 118 positioned on the movable contact portion 130 side is formed in the chamfered form 118*b*. Because of this, it is possible to reliably set the opposing distance so as to increase with increasing proximity to the end surface 118*c*.

(3) A corner portion of the contact end portion of the movable contact portion 130 positioned on the fixed contact portion 118 side is formed in the chamfered form 130*b*. Because of this, it is possible to set the opposing distance so as to increase with increasing proximity to the end surfaces.

(4) A contact conductor portion includes a fixed contact portion disposed facing the contact side surface of the movable contact portion 130, a fixed contact attachment portion facing the surface on the side of the movable contact portion 130 opposite to the contact side, and an intermediate portion that integrally links the fixed contact portion and fixed contact attachment portion in a position in a direction intersecting the arc moving direction. The fixed contact attachment portion is disposed nearer to the movable contact portion 130 than the inner surface of an arc extinguishing receptacle. Furthermore, the electromagnetic contactor 10 has an insulating cover installed between the fixed contact attachment portion and movable contact portion 130. The insulating cover includes an opposing surface portion facing the surface on the side of the movable contact portion 130 opposite to the contact side, and left and right upright portions on both sides of the opposing surface portion, heading in a direction away from the movable contact portion 130. Further, the width dimension of the opposing surface portion is set to be smaller than the width dimension of the movable contact portion 130 in a direction following the arc moving direction.

Because of this, it is possible to further extend an arc extended to an arc extinguishing chamber space. As a result of this, it is possible to more reliably extinguish the arc. Because of this, interruption performance improves.

Herein, a description has been given while referring to a limited number of embodiments but, the scope of the claims not being limited thereto, modifications of each embodiment based on the heretofore described disclosure will be apparent to those skilled in the art.

REFERENCE SIGNS LIST

10 Electromagnetic contactor
100 Contact device
101 Contact mechanism
102 Arc extinguishing chamber
105 Fixed contact support insulating substrate
111, 112 Fixed contact
115 C-shaped portion
118 Fixed contact portion
118*a* Contact portion
118*b* Chamfered form
118*c* Contact end portion side end surface
121 Insulating cover
122 L-shaped plate portion
122*a* Upper cover portion (opposing surface portion)
122*b* Side cover portion
130 Movable contact portion
130*a* Contact portion
130*b* Chamfered form
130*c* Contact end portion side end surface
132 Movable contact
141 Magnet housing pocket
143 Arc extinguishing permanent magnet
145 Arc extinguishing space
F Lorentz force

What is claimed is:

1. An electromagnetic contactor, comprising:

a contact conductor portion including a fixed contact portion having a first contact portion and first contact end portions formed at lateral ends of the first contact portion, a fixed contact attachment portion spaced apart from the fixed contact portion to form a space therebetween, an intermediate portion integrally linking the fixed contact portion and the fixed contact attachment portion to form a C-shaped portion, and chamfered portions each being formed on each side of the fixed contact portion and extending to the fixed contact attachment portion through the intermediate portion along each inner corner portion of the C-shaped portion, wherein the first contact end portion is a part of the chamfered portion;

a movable contact portion disposed in the space between the fixed contact portion and the fixed contact attachment portion, and having a second contact portion and second contact end portions formed at lateral ends of the second contact portion, respectively facing the first contact portion and the first contact end portions, the second contact portion contacting to and separating from the first contact portion, an insulating cover disposed between the fixed contact attachment portion and the movable contact portion, the insulating cover including an opposing surface portion facing a surface opposite to the second contact portion of the movable contact portion, and left and right upright portions formed on two sides of the opposing surface portion and extending in a direction away from the movable contact portion, and an arc extinguishing receptacle forming an arc extinguishing chamber housing the fixed contact portion and movable contact portion, wherein the first contact end portion is chamfered such that a distance between the first contact end portion of the fixed contact portion and the second contact end portion of the movable contact portion increases in a moving direction of an arc generated when separating the second contact portion from the first contact portion, the intermediate portion extends in a direction intersecting the moving direction of the arc, a width dimension of the opposing surface portion is smaller than that of the movable contact portion in a direction along the moving direction of the arc, and the left and right upright portions have shapes corresponding to the chamfered portions of the fixed contact attachment portion to extend the arc upwardly in the arc extinguishing chamber.

2. The electromagnetic contactor according to claim 1, wherein the movable contact portion further includes a chamfered portion formed on each second contact end portion such that a distance between the first contact end portion and the second contact end portion further increases toward each end of the second contact end portions positioned in the moving direction of the arc.

3. The electromagnetic contactor according to claim 1, wherein the contact conductor portion further includes a small diameter portion having a diameter smaller than the width dimension of the opposing surface portion; and the insulating cover further includes fitting portions inwardly projecting from ends of the left and right upright portions to fit into the small diameter portion of the contact conductor portion.

* * * * *